US005321388A

United States Patent [19]

Biersach

[11] Patent Number: 5,321,388

[45] Date of Patent: Jun. 14, 1994

[54] HIGH EFFICIENCY PHASE AND AMPLITUDE MATCHED MULTIPLE HORN ELECTRONIC SIREN

[75] Inventor: James E. Biersach, Mequon, Wis.

[73] Assignee: American Signal Corporation, Mequon, Wis.

[21] Appl. No.: 851,915

[22] Filed: Mar. 16, 1992

[51] Int. Cl.[5] ..... G08B 3/00

[52] U.S. Cl. ..... 340/404.1; 340/388.4; 381/89; 181/144; 181/142

[58] Field of Search ..... 340/405, 401, 404, 388, 340/390; 381/89; 179/115.5 H; 181/144, 147, 143

[56] References Cited

U.S. PATENT DOCUMENTS

| | | | |
|---|---|---|---|
| 3,517,390 | 6/1970 | Whitehead | 340/388 |
| 3,888,333 | 6/1975 | Yamaguchi | 181/143 |
| 4,241,334 | 12/1980 | Shintaku | 340/388 |
| 4,344,504 | 8/1982 | Howze | 181/187 |
| 4,554,531 | 11/1985 | Biersach . | |
| 4,796,009 | 1/1989 | Biersach . | |
| 4,908,601 | 3/1990 | Howze | 340/388 |
| 4,945,334 | 7/1990 | Biersach . | |
| 5,146,508 | 9/1992 | Bader et al. | 381/182 |

*Primary Examiner*—John K. Peng
*Assistant Examiner*—Nina Tong
*Attorney, Agent, or Firm*—Nilles & Nilles

[57] ABSTRACT

An electronic siren apparatus has a primary horn with a throat which splits into matched secondary horns each having sides, an output end, a longitudinal axis, and a circumference. The secondary horns are folded back toward and around the primary horn and throat and the portions of the circumference of each end are joined. The folded secondary horns and the joined portions form a cavity which houses the primary horn and throat. A driver is operatively joined with the throat and is contained within the cavity for generating sound which is transmitted through the throat and primary horn, and then into each secondary horn and out the output ends in phase and amplitude matched relation. The area of the primary horn and the combined areas of the secondary horn, satisfy the equation $$d = d_T\left[\cosh\left(\frac{x}{x_0}\right)\right]$$

where x is the distance measured along the axis from the throat, cosh is the hyperbolic cosine function, d is the diameter of the primary horn and the combined diameters of the secondary horns, $d_T$ is the diameter of the throat, and $x_0$ is determined by the equation $$x_0 = f_c\frac{2\pi}{C}$$

where $f_c$ is the cutoff frequency and c is the speed of a free sound wave front.

14 Claims, 6 Drawing Sheets

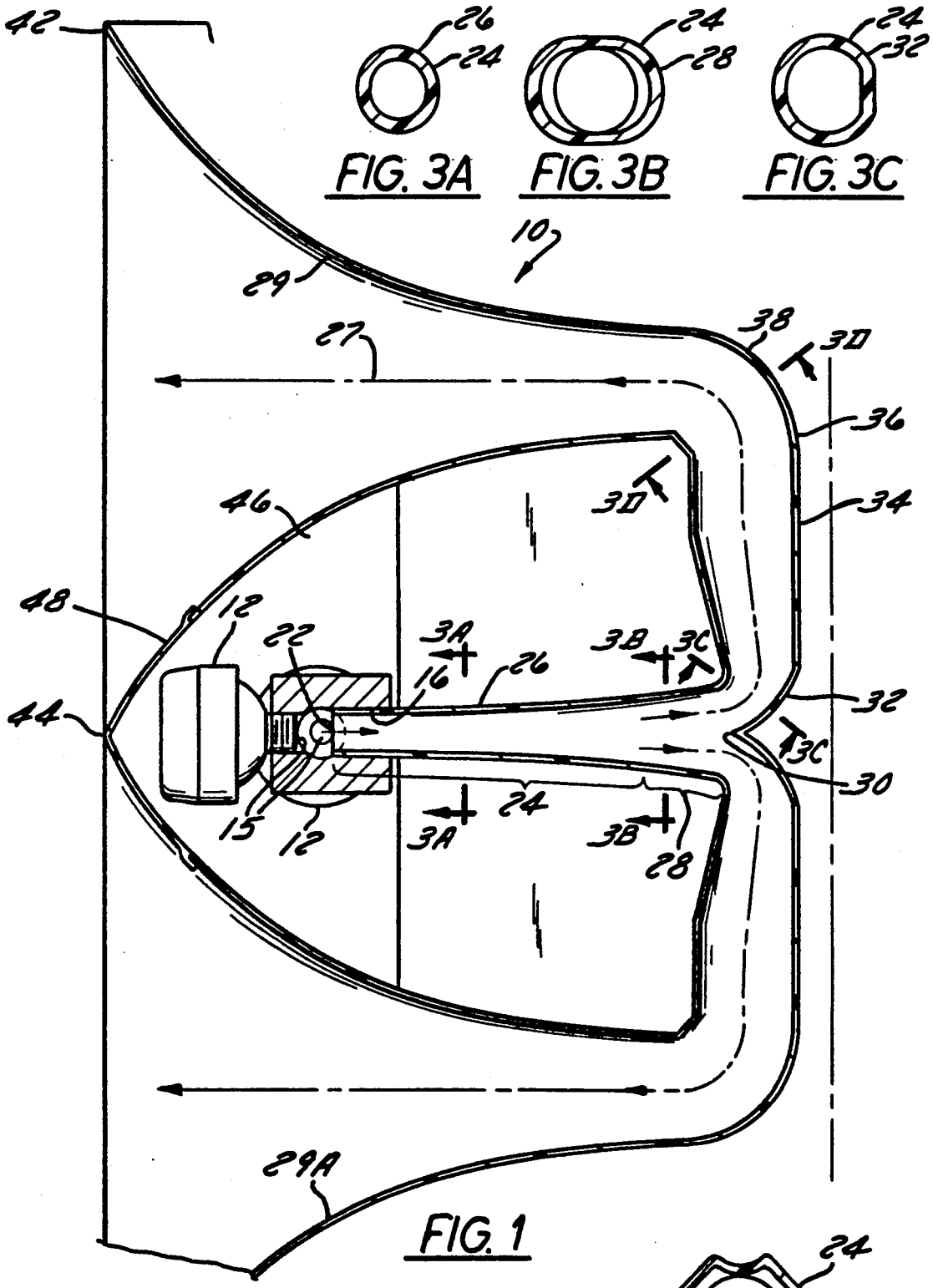
FIG. 3A FIG. 3B FIG. 3C
FIG. 1
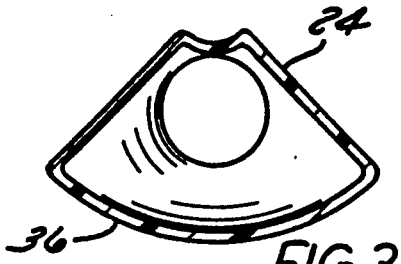
FIG. 3D

HIGH EFFICIENCY PHASE AND AMPLITUDE MATCHED MULTIPLE HORN ELECTRONIC SIREN

BACKGROUND OF THE INVENTION

1. Field of Use

This invention pertains to high powered electronic alerting and warning apparatuses for producing high volume siren tones. More particularly, the present invention pertains to a high efficiency electronic siren having multiple phase and amplitude matched horns fed by a common driver.

2. Background of the Prior Art

Electronic alerting and warning apparatuses comprise one or more loudspeakers or drivers, each having a diaphragm that is usually enclosed in a rigid housing which cooperates with the diaphragm to define in front of it an acoustical impedance chamber with a restricted output port. The housing also defines a closed chamber behind the diaphragm that contains a permanent magnet secured to the housing and the coil secured to the diaphragm. When the coil is energized with an alternating current, it cooperates with the magnet to cause vibration of the diaphragm that imparts acoustical energy to the air in front of the diaphragm. If the diaphragm of such a driver were to confront free air, very little load would be imposed upon it, and the excursions of the diaphragm, controlled only by its own stiffness and mass, could attain such amplitude that the diaphragm would be damaged. Instead, the acoustical impedance chamber in front of the diaphragm, with its restricted output port, imposes a load upon the diaphragm that limits its excursions to safe amplitude values. The impedance chamber also improves transfer of energy from the diaphragm to the free air. In conventional apparatuses, such energy transfer is further improved by connecting the driver to an appropriately designed horn that has a narrow throat portion and diverges to a flaring mouth. Typically, each horn has its own driver or set of drivers. The output port of the driver impedance chamber opens coaxially into the throat portion of the horn, which provides a restricted channel that further loads the diaphragm. The divergent portion of the horn is designed for projection of the sound output in a desired beam width.

To achieve the necessary high tonal volume desired of alerting and warning apparatuses, the prior art has addressed the problem by simply adding more horns, each horn having its own driver or set of drivers. Because the properties of air are such that there tends to be an upper limit to the load that can be imposed upon a driver diaphragm by acoustical impedance means, and correspondingly there tends to be an upper limit to the electrical power that can be safely applied to the driver, the necessity for increased volume has been addressed by increasing the number of horns and drivers. Incorporating a number of electronic drivers into outdoor alerting and warning apparatuses is disclosed in U.S. Pat. No. 4,796,009 which discloses a warning device having numerous electronic drivers attached to a resonance chamber having one or two coaxial outlet ports each opening into the throat of a horn. This type of approach is typical of the prior art and simply involves throwing more power at the problem rather than increasing efficiency. Increasing power generated by a warning apparatus has also been addressed by improved energizing means for drivers as disclosed in U.S. Pat. No. 4,945,334.

In addition to the necessity of maximizing the volume of the tones emitted from the sirens, it is also increasingly desirable to control the directionality of such tones especially in areas where only a portion of the population needs to be warned of impending danger. In conventional apparatuses, multiple independent sets of sirens are required to implement a warning system that can provide anywhere from highly directional to omni-directional emission of warning tones. For example, in a situation where there exists one quadrant of the warning area that need not receive the warning tones, the installer must typically nonetheless purchase an apparatus that is omni-directional and emits an omni-directional warning tone or purchase an apparatus that was intended for omni-directional use but is partially disabled or left incomplete at the factory to accomplish the desired directionality. In each case, the installer typically pays for structure, such as an omni-directional resonance chamber, that is not needed or used.

Improved directionality of warning tones is typically addressed in conventional warning apparatuses by taking a conventional resonance chamber such as disclosed in U.S. Pat. No. 4,796,009 discussed above, and adding horns in the desired direction of the tonal transmission. As discussed above, this approach is wasteful because much of the area of the resonance chamber is left unused, much of the materials used to construct it are wasted, and the cost for this unnecessary structure is passed on to the customer.

SUMMARY OF THE INVENTION

The present invention provides a high efficiency phase and amplitude matched multiple horn electronic siren. More specifically, the invention provides a high efficiency electronic siren having a single driver or set of drivers feeding a split horn having adjacent stacked horn output ends. In one aspect of the invention, one large driver or a plurality of smaller less powerful drivers feed an exponential horn (hyperbolic cosine function) having two branches. The output ends of each horn branch are adjacent each other and emit phase and amplitude matched tones generated by the single driver or set of drivers. The matched horn outputs yield improved sound concentration and efficiency as compared to a single horn driven by the same number of drivers or two horns driven by two sets of drivers. The sound waves emitted from the matched horns cooperate with and balance each other to yield a wave front having planar characteristics. For long distance tonal transmission, the planar wave fronts oriented from vertically stacked matched horns of the present invention travel much greater distances than the spherical wave front produced by a single horn or the spherical and unmatched wave fronts produced by multiple unmatched horns. The improved sound concentration, moreover, is achieved with fewer drivers than required in prior art siren apparatuses.

In another aspect of the present invention, the matched horns fed by a single driver or set of drivers may stacked with other matched horns in the vertical direction to further improve transmission of the warning tones over great distances. The length of the planar portion of the wave front emitted from the stacked horns increases as the number of matched horn sets increases. The present invention thus enables higher efficiency transmission and improved sound concentration than prior art apparatuses and with fewer drivers. Users thus experience improved performance and cost savings.

In another aspect of the present invention, the matched split horns driven by a single driver or set of drivers may be fabricated in self-contained quadrants comprising a single driver or set of drivers feeding split horns stacked adjacent, typically in the vertical direction with respect to each other. The quadrant, having two planar surfaces at 90° to each other forming the sides of the quadrant, and a generally curved surface connecting the two planar surfaces and forming the side of the quadrant from which the warning tones are transmitted, may be mounted securely to an interior corner. In another embodiment, two quadrants may be joined together at one of their planar surfaces to form a warning apparatus having one larger planar surface and one larger generally curved tonal emitting surface and thereby may be securely flush mounted to the side of a building or a wall. In another embodiment, three self-contained quadrants may be joined together to form a 270° warning apparatus structure that may be mounted to the exterior corner of a building to direct the warning tones in all directions away from the building. Such a structure may be mounted securely and flush to the exterior corner of the building and therefore withstand even the worst environmental forces. In yet another embodiment, four quadrants may be joined together to form a 360° siren which may be pole or tower mounted as may be needed. Each quadrant of the above embodiments may be selectively controllable for controlling the direction of the tones transmitted from the siren.

In each embodiment the cables or wires bringing power to the single driver or set of drivers in each quadrant may be run flush with the apex of each quadrant which apex may be fabricated with a small concave passage to accommodate the wires. Means for hoisting the siren may also be accommodated in the passage. An access door may be provided in the generally curved front surface of each of the quadrants to access the driver or set of drivers in each quadrant for maintenance purposes.

The high efficiency phase and amplitude matched multiple horn electronic siren of the present invention lends itself to being fabricated so as to be virtually impenetrable and unaffected by environmental forces. The driver or set of drivers which drives the split horn in each quadrant is securely and virtually imperviously nestled between the two matched horns. Furthermore, wind-borne snow, ice, or debris is not able to enter the cavity in each horn which leads to the driver because any build-up of such materials will follow the slope of each matched horn outwardly from the horn. If such debris falls into, for example, the upper horn branch, the debris will find its way out the lower branch and will not block the horns or contaminate the driver. The horns are preferably fabricated so that all surfaces of the horns are sloped outwardly for draining.

BRIEF DESCRIPTION OF THE DRAWINGS

FIG. 1 is a schematic, cross-sectional view of the phase and amplitude matched multiple horn electronic siren of the present invention;

FIGS. 3A-D are schematics of the cross-sectional views, along lines 3A—3A to 3D—3D, respectively, in FIG. 1, of a horn of the present invention at various locations along its axis;

DESCRIPTION OF THE PREFERRED EMBODIMENT

Figure 2A:
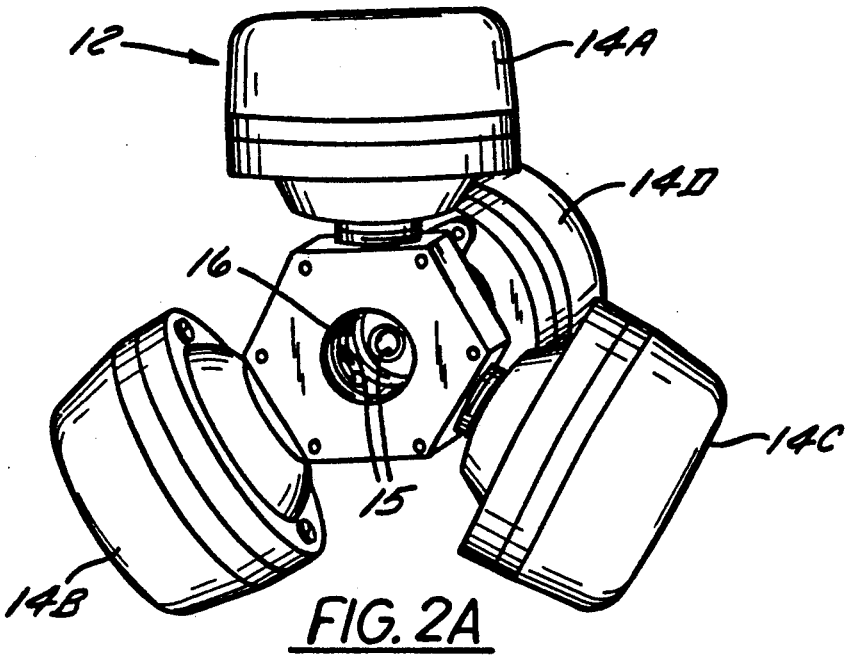
FIG. 2A is a perspective view of a set of drivers used with the siren of the present invention.
Figure 2B:
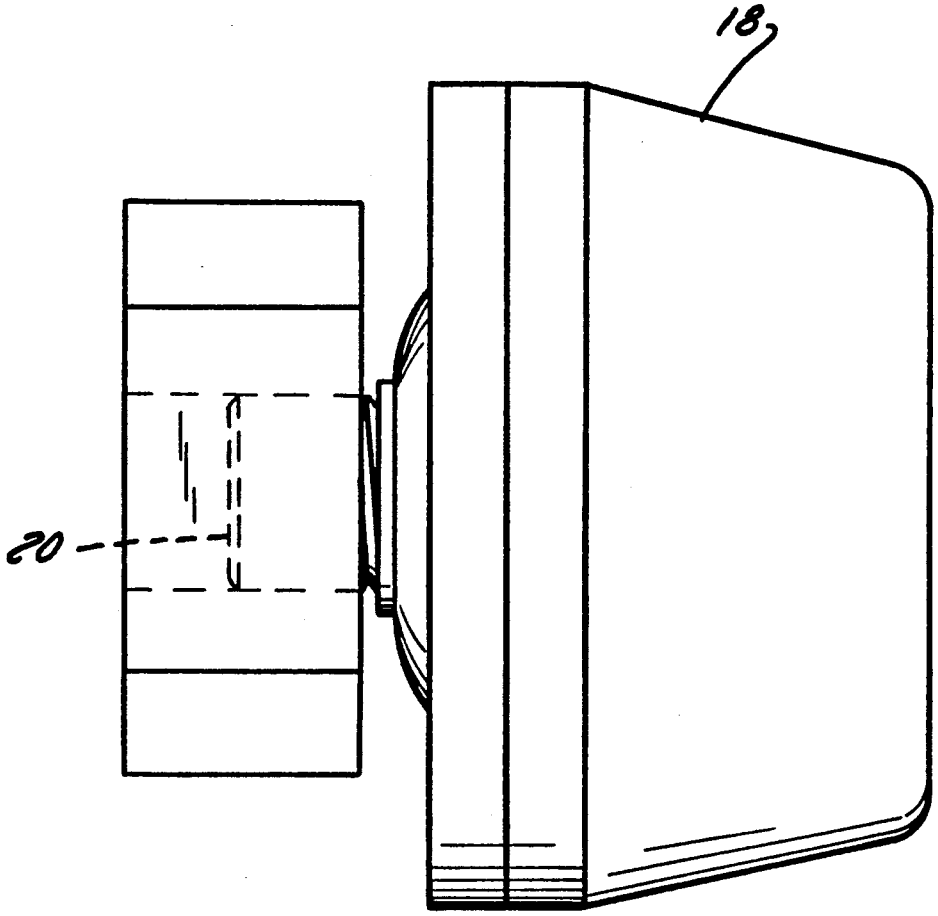
FIG. 2B is an elevational view, partially in section and on an enlarged scale, of one of the drivers shown in FIG. 2A.

A high efficiency phase and amplitude matched multiple horn electronic siren 10 is depicted in FIG. 1 and may comprise a set (FIG. 2A) of multiple drivers 14A-D each having an output port (not shown) cooperating with an outlet aperture 16. The set of drivers 12 may comprise standard drivers used in the art and need not be further described here except to state that the set of drivers 12 may be replaced by a single more powerful driver 18 (FIG. 2B) having outlet aperture 20. The outlet aperture 16 (FIG. 2A) of the set of drivers 12 is joined with a throat 22 (FIG. 1) of the horn 10. The area of the throat 22 may preferably match that of the outlet aperture 16 of the set of drivers 12 so that no audio losses occur at this juncture. Furthermore, the area of the outlet aperture 16 may preferably equal the combined area of the output ports (not shown) of each of the drivers 14A-D (FIG. 2A).

The horn 10 further comprises a primary horn portion 24 (FIG. 1) the sides of which are parallel to each other proximal the throat 22. The sidewalls of the primary portion of the horn 10 begin to gradually flare out at 26. A representative cross-section of portions 24 and 26 of the horn 10 can be seen in FIG. 3A. These portions may have a simple circular cross-section. Further outwardly along the length of the horn, it can be seen that portion 28 of the horn 10 is a transition portion of the horn which leads to two separate but preferably matched secondary horns 29, 29A or branches of the horn 10 having longitudinal axis 27. The transition portion 28 may have a cross-section which is expanded in one direction to form what may be termed an ob-round cross-section as is depicted in FIG. 3B. Knife edge 30

(FIG. 1) defines the beginning of the two separate branches.

Each branch may generally curve 90° away from the primary horn 24 at curve 32. FIG. 3C shows the cross-section of each of the branches at curve 32 which cross-section may be defined in part by a cord which, in this embodiment, was dictated by the desired compact and weatherproof packaging later described. Further along each axis of each branch of the horn 10 and generally at 34, the cross-section of the horn may again become a circle of increasing diameter. Beginning generally at the location 36 and continuing through the 90° curve 38, the cross-section of each branch of the horn 10 changes from a simple circle to a more complex cross-section comprised of circular sections of varying diameters as seen in the cross-sectional view of FIG. 3D as the branch begins to flare and transition toward flared portion 40 and toward its end 42 as seen in the cross-sectional view of FIG. 3D. The portion of each end 42 of each of the horn branches meet at the juncture 44 where the horns may be joined. It can be seen that the set of drivers 12 is effectively and securely enclosed in the cavity 46 defined by the matched branches of the horn 10. An access door 48 may be employed at the merging point 44 or nearby to enable access to set of drivers 12.

The horn of the present invention is preferably made of molded fiberglass which is rigid and the horn walls will not move due to the pressure involved.

Although the specific embodiment discussed above has a somewhat complex horn shape which was beneficial from the standpoint of compactness, it should be understood that the high efficiency phase and amplitude matched multiple horn electronic siren of the present invention may take any number of different shapes. For example, rather than the somewhat squared off shape discussed above having nearly right angle curves at portions 32 and 38, each branch of the horn may be a smooth curve. Virtually any shape may be used as long as it meets the necessary horn design criteria now discussed.

Figure 4:
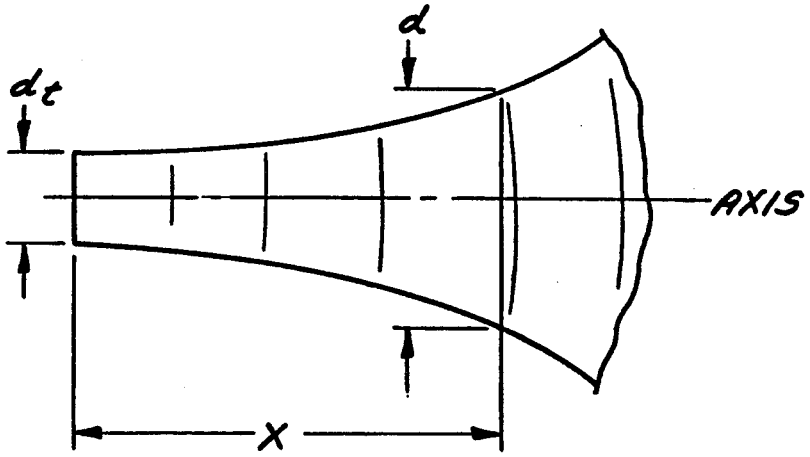
FIG. 4 is a schematic, fragmentary view of a horn and its parameters.

As discussed in *The Electrical Engineer's Handbook*, 4th Edition, 1950, John Wiley & Sons Inc., publishers, at pages 13–05 through 13–08, the total radiation response of a horn is determined largely by its throat impedance as a function of frequency. Transmission losses should be minimized, so that the energy output is closely equal to the input. Rigorous calculation of throat impedance is possible for only a few useful horn contours, and so approximate methods are usually used. The low frequency region is of greatest interest because high frequency throat mechanical impedance approaches a constant resistance that is the same per unit area for all horns. The low frequency wave fronts in the horn are smoothly curved surfaces and there results a pressure wave equation in which the only space variable is the axial distance. For convenience, all horn design work is usually referred to a straight axis horn of circular cross-section as shown in FIG. 4. As seen in FIG. 4, the basic horn parameters are throat diameter $d_T$, diameter d, and axial distance x as measured along the axis. The cords (diameter d in FIG. 4) for the wave fronts are approximately proportional to the square root of the area of the wave front, provided that the expansion of the horn is not too rapid. If the sound pressure is assumed to decrease steadily as the horn expands, modified by the change of phase down the horn, this assumption may be expressed analytically and inserted into the pressure wave equation together with the relation between d and the area of wave front. This leads to a relation between d and x, the axial distance, which when solved yields $$d = d_T\left[\mathrm{COSH}\left(\frac{x}{x_0}\right) + T\,\mathrm{SINH}\left(\frac{x}{x_0}\right)\right]. \qquad \text{Equation No. 1}$$

Here, $d_T$ is the diameter at the throat, $x_0$ is a reference distance fixing the rate of taper of the horn and is related to the cut-off frequency $f_c$ by $$X_0 = f_c\frac{2\pi}{c} \qquad \text{Equation No. 2}$$

where c is the speed of a free sound wave front and T is a parameter by which a particular horn contour is selected. T in the most widely used horn contours is equal to zero and is taken as zero for purposes of this discussion. In other embodiments of the present invention, however, T may be chosen not equal to zero.

It can be seen that if T equals zero Equation 1 becomes $$d = d_T\left[\mathrm{COSH}\left(\frac{x}{x_0}\right)\right]. \qquad \text{Equation No. 3}$$

The area of a horn having a simple circular cross-section can then be calculated for any axial distance x based on the diameter d derived from Equation 3 using the formula $A=\pi r^2$. It can be seen that where the cross-section of the horn is not a simple circle but is described by a more complex function, that the area of the horn at that axial distance x may nonetheless be calculated rapidly using advanced computer based CAD programs. The calculated area of the horn having a complex cross-section may then be used to insure that the horn design meets the proper relation between d and x. As understood in the art, horn design, especially the design of horns having complex cross-sections, necessarily entails the use of approximate methods and is typically not subject to rigorous calculation.

In short, the horn of the present invention can be made in any number of different shapes but each horn must be designed so that it meets the fundamental horn design requirements of Equation 1. As is appreciated in the art, typically, a cut-off frequency, $f_c$, is chosen and then $x_0$ is calculated based on that cut-off frequency pursuant to Equation 2 above. Then, for a given throat diameter $d_T$ and a chosen T, calculation of the proper diameter and area for multiple incremental axial distances x may take place. The horn embodiment of the present invention discussed above was based on a cut-off frequency $f_c$ of 200 Hz and T=0. The area of the horn was calculated at axial distances x ranging from one inch to one-half inch depending on the degree of complexity of the cross-section of the horn at a particular axial distance x from the throat. For example, the transition portion 28 which leads from a single volume into two branches was calculated at one-half inch intervals x.

The necessary horn area, A, calculated for the horn 10 and derived using the calculated value of d from Equation 3 is for the horn as a whole. In prior art horn designs, which are not branched, only one calculated area exists at a particular axial distance x, unlike in the present invention where the horn is split into two matched branches thus yielding two calculated areas A. The calculated area A of the horn for any given axial distance x beyond the knife edge 30 must be split equally between the horn branches. If it was found desirable to split the horn 10 into more than two branches, then the area of each branch would equal the calculated area A divided by the number of branches.

Figure 5:
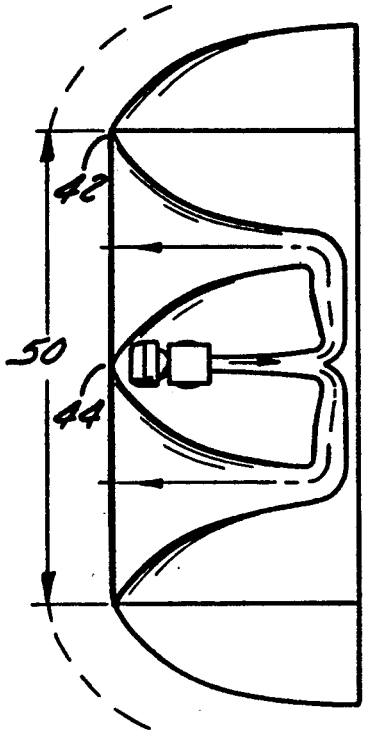
FIG. 5 is a schematic view showing a siren of the present invention and a planar wave front.
Figure 6:
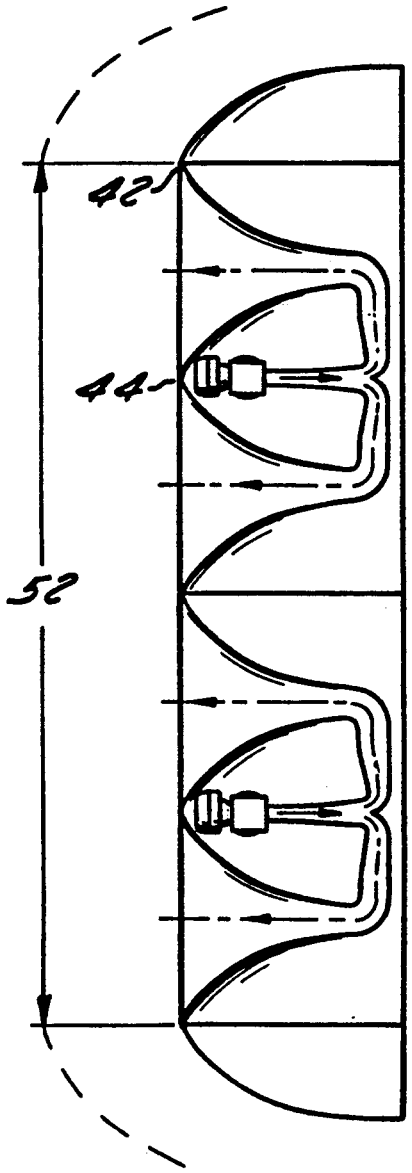
FIG. 6 is a schematic view showing two sirens of the present invention stacked and in line, and an extended planar wave front.

Because of the matched nature of the branches of the horn 10, the tones emitted from the set of drivers 12 down the primary horn 24 toward the knife edge 30 and into each of the branches will be phase and amplitude matched throughout the length of the horn and as the tones exit the horn ends 42. The opposing pressure waves at the merging point 44 balance each other and create a planar wave front as seen in FIG. 5 depicting planar wave front segment 50. The extent of the planar wave front can be increased by stacking two sirens of the present invention in line as seen in FIG. 6 depicting extended planar wave front segment 52. For long distance transmission of warning tones, numerous sirens of the present invention may be vertically stacked with respect to each other to maximize the planar wave front and thereby increase the power of the emitted tones in the horizontal direction.

Figure 7:
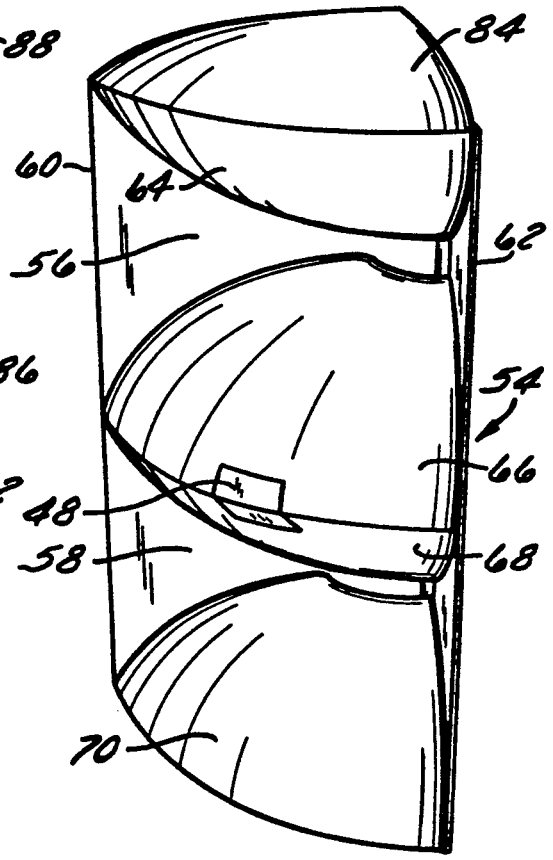
FIG. 7 is a perspective view of the siren of the present invention in the form of a quadrant.

The siren of the present invention not only yields superior performance with respect to prior art sirens, but may be manufactured in an extremely economical, compact, and protected unit. Referring to FIG. 7, an electronic siren of the present invention is depicted in quadrant form. As seen in this figure, the vertically oriented siren 54 comprises upper horn 56 and lower horn 58. The planar sidewalls of the upper and lower horns are designated 60 and 62 and are at right angles to each other and form an apex (not shown). With respect to upper horn 56, the sidewalls 60 and 62 are integral with an upper exponential horn surface 64 and a lower exponential horn surface 66 which may preferably be designed in accordance with the equations discussed above. With respect to lower horn 58, the sidewalls 60 and 62 are integral with an upper exponential horn surface 68, the upper circumference of which is integral with the lower circumference of lower exponential horn surface 66 of the upper horn 56, and a lower exponential horn surface 70. As can be partially seen in FIG. 7, the upper horn 56 continues inwardly into the surfaces 66 and 68 and is in communication with the drivers located between and interior of surfaces 66 and 68. Access port 48 may be formed in surfaces 66 and 68 for access to the driver in the interior cavity.

Figure 8:
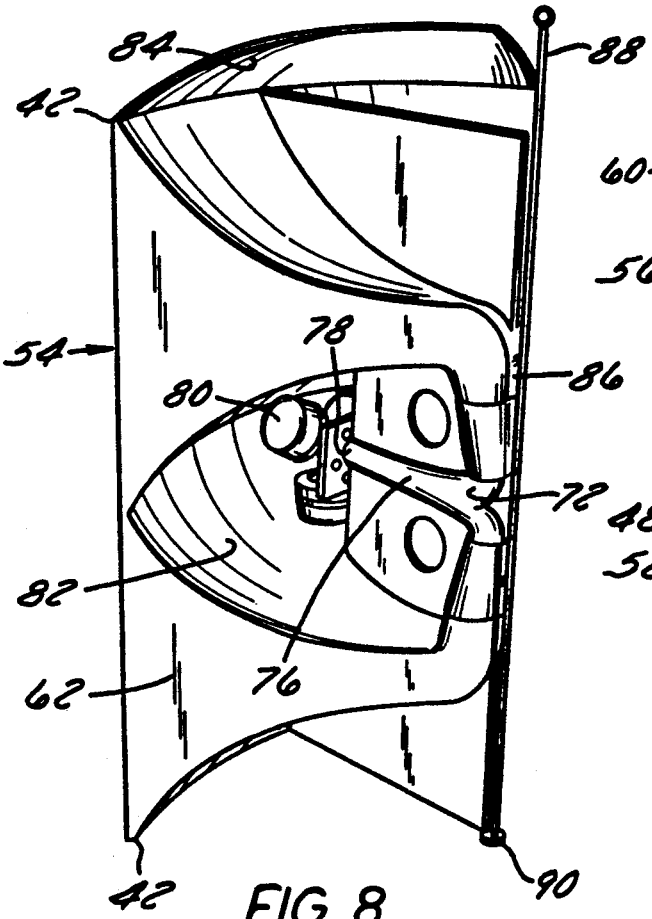
FIG. 8 is a perspective view of the interior of the siren of FIG. 7.

Referring now to FIG. 8 the interior portion of the siren 54 of FIG. 7 can be seen. The horns 56 and 58 and their respective branches are seen from their outer ends 42 to the point where they are joined at the transition portion 72 and into primary horn portion 76. Also seen is the juncture between the throat 78 and the set of drivers 80 which are affixed to the throat 78 with conventional fastening means. It can be appreciated that the drivers 80 may be fully enclosed and protected in the interior cavity 82 between the upper horn 56 and the lower horn 58 after mounting the siren 54 in an interior corner or by joining an additional siren 54 to each side, or by supplemental side panels mounted flush with side walls 60 and 62. It can be seen that the siren of the present invention depicted in FIG. 8 is particularly compact and uses space and materials efficiently.

The siren of the present invention depicted in FIG. 8 clears itself of foreign debris such as snow or ice because there is no surface in the siren 54 on which such debris can come to rest or migrate toward the interior of the siren. Such debris tends to fall out of the siren along the curved surfaces 66 and 70 which would, in the conventional case, collect such debris to the detriment of the siren. If debris does enter, for example, the upper horn 56 and make its way into the upper horn branch, it will find its way out of the lower horn 58 and will not block the horns or contaminate the driver. This is ensured because the lower surface of the primary horn portion 76 is canted downwardly from the drivers 80 to the transition portion 72. The squared-off shape of the branches facilitates compact packaging of the siren but that particular shape is not necessary and may be replaced by other suitable branch shapes. A cap 84 may also be used to prevent debris from collecting above the horn 56.

Figure 9:
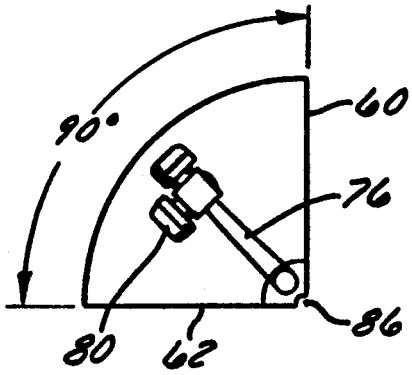
FIG. 9 is a schematic plan view of the quadrant of FIGS. 7 and 8.

Electrical cables or wires (not shown) which power the drivers 80 may preferably be run unobtrusively up the apex 86 of the siren 54 as seen in FIGS. 8 and 9. The apex may be a concavity as seen in FIG. 9 and is provided for as discussed above by squaring-off the branches so that a straight passage exists at the apex of the quadrant. Furthermore, means for hoisting the siren to its desired installation location in the form of a rod or cable 88 may run from the bottom of the siren apex at 90 to above the cap 84 in the apex passage. Hoisting means 88 distributes the weight of the siren throughout the siren thereby insuring the structural integrity of the siren, which preferably comprises a molded fiberglass shell, remains intact.

Figure 10:
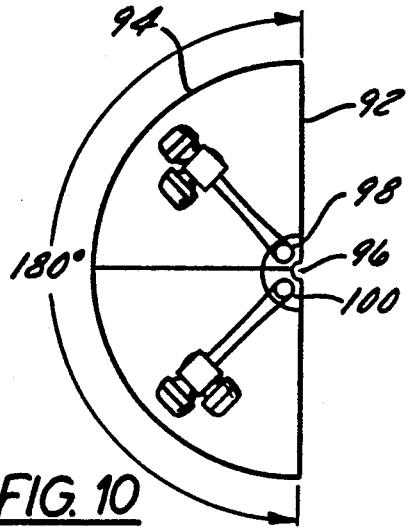
FIG. 10 is a schematic plan view of two quadrants joined together to form a 180° siren of the present invention.

Referring to FIG. 10, a schematic of a siren suitable for mounting on the side of a building or a wall is shown and comprises two sirens of the present invention in quadrant form and joined at their sidewalls to form a 180° siren. The 180° siren has a flat mounting surface 92 and a 180° circumferential emitting surface 94. This embodiment may be securely flush mounted on side 92 to the side of a building to withstand high wind forces. Internal structure of the joined quadrants of the flush mounted siren may include a passage 96 aligned with the vertical axis and defined by the apex 98 and 100 of each quadrant.

Figure 11:
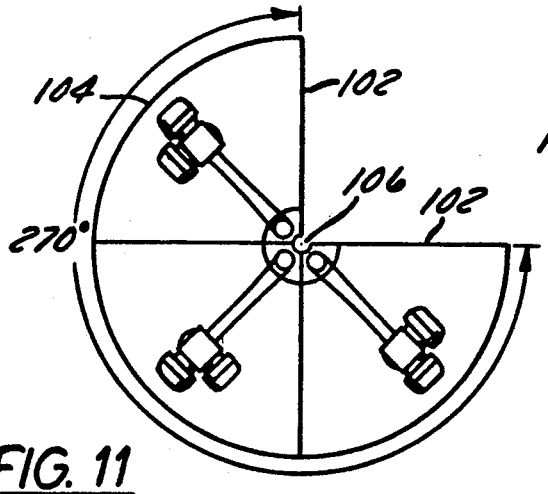
FIG. 11 is a schematic plan view of three quadrants joined together to form a 270° siren of the present invention.

FIG. 11 depicts a 270° siren of the present invention suitable for mounting on an exterior corner of a building on mounting surface 102. It can be appreciated that this embodiment transmits the warning tone in all directions from except toward the building from 270° circumferential emitting surface 104 and otherwise may comprise three 90° sirens or quadrants. A vertical passage 106 is depicted.

Figure 12:
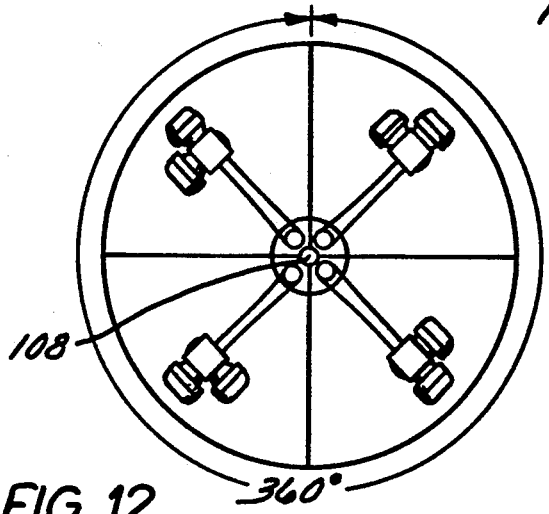
FIG. 12 is a schematic of four quadrants joined together to form an omni-directional siren of the present invention.

FIG. 12 depicts an omni-directional siren of the present invention comprising four quadrants which form a 360° structure and which otherwise is of similar structure to the 90° siren. A vertical passage 108 is depicted.

The user of sirens of this invention may use only the quadrant or quadrants demanded by his application. If the user is to install the siren on an interior corner of a large room for instance, only one quadrant would be needed. If the user were desirous of installing a siren of the present invention on the side of a building, only two quadrants, joined together would be needed. If the user were desirous of installing the siren of the present invention on an exterior corner of a building he need only purchase three quadrants joined together. If the user were desirous of installing an omni-directional siren of the present invention on a roof top, for example, then all four quadrants would be used. It can be appreciated that the siren of the present invention permits the structure of the siren to be minimized to suit a user's particular needs and thus decrease the cost to the user.

Figure 13:
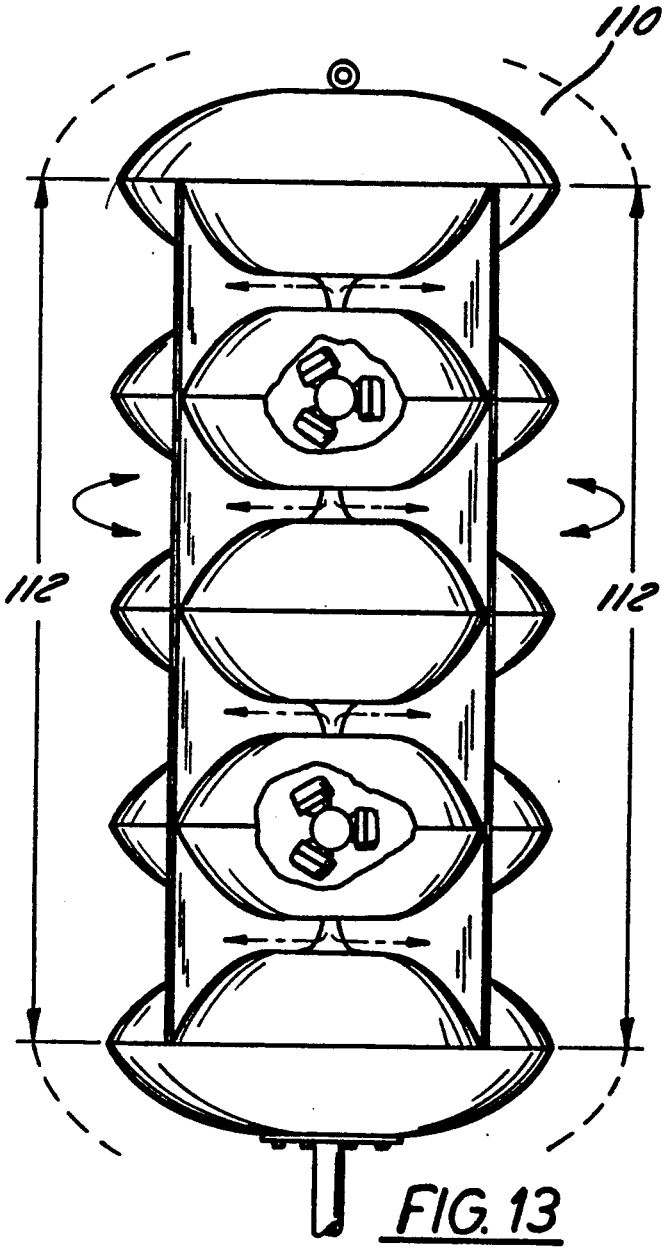
FIG. 13 is a schematic, elevational view, with certain parts broken away for clarity, of a dual stacked omni-directional siren of the present invention.

A cross-sectional view of a dual stacked omni-directional siren of the present invention comprising eight siren quadrants whose vertical axes and output ends are aligned is depicted in FIG. 13. The extended planar wave front 112 emitted by the siren can be seen.

Figure 14:
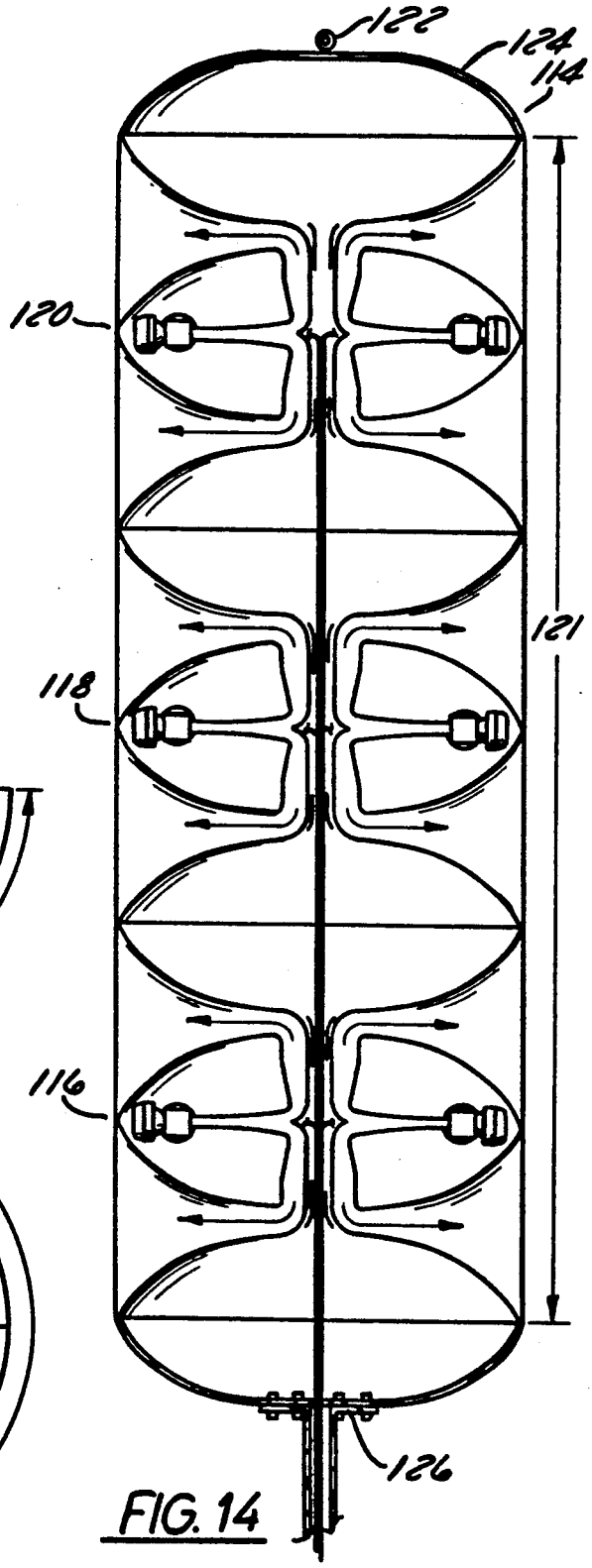
FIG. 14 is an elevational, vertical cross-sectional view showing the interior of a triple stacked omni-directional siren of the present invention.

FIG. 14 is a cross-sectional view of a triple stacked omni-directional siren 114 of the present invention comprising three omni-directional sirens 116, 118 and 120, stacked together, that is a total of twelve siren quadrants whose vertical axes and output ends are aligned. An extended planar wave front 121 is generated by this embodiment. A hoisting eyelet 122 is seen at the top of cap 124 and a pole mounting bracket 126 is depicted at the bottom of the siren 114. Virtually any number of combinations of quadrants and stacking may be employed to satisfy almost any siren application.

It is to be understood that embodiments of the present invention not disclosed herein are intended to be within the scope of the claims.

I claim:

1. An electronic siren apparatus comprising:

a driver assembly;

a horn comprising a throat operatively joined with said driver assembly, said throat being split into distinct matched branches, wherein each of said branches has a longitudinal axis and an output end presenting a circumference;

said output ends positioned so that said longitudinal axes of said output ends are generally parallel to each other and so that said circumference of said branches are adjacent to each other such that sound wave fronts emitted from said output ends are phase and amplitude matched and balanced with respect to each other to form a planar wave front.

2. The apparatus of claim 1 wherein said driver assembly comprises a group of drivers.

3. The apparatus as defined in claim 1 wherein said driver assembly comprises a single driver.

4. The apparatus as defined in claim 1 wherein said branches comprise two branches.

5. The apparatus as defined in claim 1 wherein said driver assembly is situated in a cavity defined by said branches.

6. An electronic siren apparatus comprising:

a horn comprising a primary horn having a throat, said primary horn being split into distinct matched second horns, each of said secondary horns having a longitudinal axis and an output end presenting a circumference;

said secondary horns being folded back toward and around said primary horn and said throat, wherein portions of said circumferences of said secondary horns are joined to one another;

said secondary horns and said joined portions of said circumferences cooperating to form an enclosed cavity housing said primary horn and said throat;

driver means, operatively joined with said throat and contained within said cavity, for generating sound which is transmitted through said throat and said primary horn and into said secondary horns and out said output ends in phase and amplitude matched relation.

7. The apparatus as defined in claim 6 wherein an area of said primary horn, and combined areas of said secondary horns, satisfy the equation $$d = d_T\left[\mathrm{COSH}\left(\frac{x}{x_0}\right)\right]$$

where x is a distance measured along said longitudinal axis from said throat, cosh is a hyperbolic cosine function, d is a diameter of said primary horn and combined diameters of said secondary horns, $d_T$ is a diameter of said throat, and $x_0$ is determined by the equation $$X_0 = f_c\frac{*2\pi}{c}$$

where $f_c$ is a cutoff frequency and c is a speed of a free sound wave front.

8. An electronic siren apparatus comprising a quadrant formed from two planar sidewalls joined at an apex, each said sidewall having a vertical axis, and a passage in said apex aligned with said vertical axis, a first horn and a second horn being positioned in said quadrant, said first horn including a primary horn portion and a first secondary horn branch, said second horn including said primary horn portion and a second secondary horn branch, said first and second secondary horn branches merging into said primary horn portion, said primary horn portion being operatively joined with a driver, each of said first and second secondary horn branches having an output end presenting a circumference, said first horn and said second horn cooperating to form a cavity which houses said driver, a portion of said circumference of said first secondary horn branch being joined to a portion of said circumference of said second secondary horn branch.

9. An electronic siren apparatus comprising two 90° siren segments, each said segment having two planar sidewalls joined at an apex, each said sidewall having a a vertical axis, said segments being joined together to form a 180° siren, said 180° siren having a passage aligned with said vertical axis, each said segment having a first horn and a second horn, said first horn including a primary horn portion and a first secondary horn branch, said second horn including said primary horn portion and a second secondary horn branch, said primary horn portion being operatively joined with a driver, each of said first and second secondary horn branches having an output end and a circumference at said output end, said first horn and said second horn of each said segment cooperating to form a cavity which houses said driver, a portion of said circumference of said first secondary horn branch being joined to a portion of said circumference of said second secondary horn branch.

10. The apparatus as defined in claim 9 further comprising means for mounting said siren to a flat surface.

11. An electronic siren apparatus comprising three 90° siren segments, each said segment having two planar sidewalls joined at an apex, and each said sidewall having a vertical axis, said segments being joined together to form a 270° siren, said 270° siren having a passage aligned with said vertical axis and defined by each apex, each said segment having a first horn and a second horn said first horn including a primary horn portion and a first secondary horn branch, said second horn including said primary horn portion and a second secondary horn branch, said primary horn portion being operatively joined with a driver, each of said first and second secondary horn branches having an output end and a circumference at said output end, said first horn and said second horn of each said segment cooperating to form a cavity which houses said driver, a portion of said circumference of said first secondary horn branch being joined to a portion of said circumference of said second secondary horn branch.

12. The apparatus as defined in claim 11 further comprising means for mounting said siren to an exterior corner of a building.

13. An omni-directional electronic siren apparatus comprising four 90° siren segments, each said segment having two planar sidewalls joined at an apex, each said sidewall having a vertical axis, said segments being joined together to form a 360° siren, said 360° siren having a passage aligned with said vertical axis, each said segment having a first horn and a second horn, said first horn including a primary horn portion and a first secondary horn branch, said second horn including said primary horn portion and a second secondary horn branch, said primary horn portion being operatively joined with a driver, each of said first and second secondary horn branches having an output end and a circumference at said output end, said first horn and said second horn of each said segment cooperating to form a cavity which encloses said driver, a portion of said circumference of said first secondary horn branch being joined to a portion of said circumference of said second secondary horn branch.

14. The apparatus as defined in claims 8, 9, 11, or 13 further comprising 1) means for hoisting said siren, and 2) means for powering said siren, said means for powering being located in said passage.

* * * * *